United States Patent [19]

Kelly

[11] Patent Number: 5,033,660

[45] Date of Patent: Jul. 23, 1991

[54] WIRE HANGER TO HOLD HATS

[76] Inventor: Thomas J. Kelly, 630 W. Third St., Chadron, Nebr. 69337

[21] Appl. No.: 522,730

[22] Filed: May 14, 1990

[51] Int. Cl.[5] ..... A47G 25/10; A47F 7/06

[52] U.S. Cl. ..... 223/85; 223/88; 211/30; 211/31

[58] Field of Search ..... 223/85, 88, 89; 211/30, 211/31; 248/340

[56] References Cited

U.S. PATENT DOCUMENTS

| | | | |
|---|---|---|---|
| 1,393,843 | 10/1921 | Smith . | |
| 1,571,598 | 2/1926 | Nordendale et al. . | |
| 1,970,943 | 8/1934 | Raymond | 223/85 |
| 1,990,211 | 2/1935 | Stinson | 223/88 |
| 1,992,359 | 2/1935 | Didge . | |
| 2,177,546 | 10/1939 | Johnson | 211/30 |
| 2,341,643 | 2/1944 | Mincenberg | 211/30 |
| 2,574,557 | 11/1951 | Goodhand | 211/30 |
| 2,720,984 | 10/1955 | Gotowka | 211/30 |
| 4,346,825 | 8/1982 | Leger | 223/66 |
| 4,583,646 | 4/1986 | Bowman | 211/32 |

*Primary Examiner*—Werner H. Schroeder
*Assistant Examiner*—Bibhu Mohanty
*Attorney, Agent, or Firm*—Burd, Bartz & Gutenkauf

[57] ABSTRACT

A hat holding device has a generally circular ring adapted to encircle a hat. The ring is pivotally mounted on lateral supports of a hanger member. The ends of the lateral supports have loops that project downwardly and terminate in a generally horizontal U-shaped body. The U-shaped body extends into the interior of the hat to support the hat and retain the hat inside of the ring. The mid-portion of the hanger member has a downwardly turned hook adapted to be placed on a support to remove the hat from the risk of damage.

24 Claims, 1 Drawing Sheet

WIRE HANGER TO HOLD HATS

FIELD OF THE INVENTION

The invention relates to holders for accommodating hats, particularly hat holders adapted to be hung from a support thereby preventing inadvertent damage to the hat.

BACKGROUND OF THE INVENTION

Commonly, hats are placed on a table, counter top, or floor thereby subjecting the hats to possible damage. The hats can be crushed, spilt on or otherwise defiled. Hats placed out in the open increases the clutter and messiness of a household, establishment, or office. Prior hat holding devices have been used to support hats. These devices use rings connected to a hanger for accommodating a hat. The prior hat holders do not provide support to the interior of the hat whereby the crown of the hat may be damaged.

SUMMARY OF THE INVENTION

The invention is directed to a hat holder operable to hold and hang a hat in a desired location without fear of damage. The holder has a ring that surrounds the brim of the hat pivotally supported on a hanger member. The hanger member has a horizontal body that extends into the inner portion of the hat to support the hat and hold the hat within the ring. The hat holder allows a hat to be stored in a safe and orderly fashion thereby reducing clutter in the home or office. Also, the hat holder may be used in a suitcase when one is traveling.

The preferred embodiment of hat holder comprises a generally circular ring adapted to surround the side wall of a hat adjacent the brim or bill thereof. The ring has a pair of upper ends that are pivotally supported on lateral members of a hanger member. The ends of the ring incline upwardly to the lateral members thereby transversely spacing the ring from the hanger member. This prevents the bill of the hat accommodated by the holder from being crushed between the ring and the hanger member. The outer ends of the lateral members have loops connected to arms that extend downwardly to a generally U-shaped horizontal member or body. The horizontal body is a support adapted to extend into the interior of the hat. The horizontal body supports the hat and retains the side wall of the hat within the ring. When the holder is in the closed position, the horizontal member extends through the ring adjacent the top of the hat. This provides support for the hat and prevents the crown and side wall of the hat from collapsing toward the brim of the hat. One of the lateral members of the hanger member has a downwardly turned hook adapted to be placed on a support. This enables the holder to be hung in a closet or a rack thereby reducing the risk of damage to the hat.

DESCRIPTION OF THE PREFERRED EMBODIMENT

Referring to FIGS. 1 to 4, there is shown the hat holder of the invention indicated generally at 10 usable to hang a straw, felt or western style hat without fear of damage. Holder 10 can be supported on a pole in a clothes closet or on any hook. The holder 10 also may be used in a suitcase when traveling.

Figure 6:
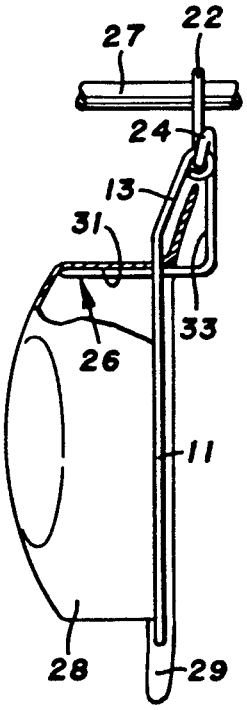
FIG. 6 is a partially sectioned side view of FIG. 5.

Holder 10 has a generally circular ring 11 pivotally supported on lateral members 18 and 19 of a hanger member 17. Ring 11 and hanger member 17 are preferably made with metal wire materials. Other materials, such as plastic, can be used to construct ring 11 and hanger member 17. Ring 11 has generally parallel end members 12 and 13 that extend upwardly and inwardly from the upper ends of the circular part of the ring to lateral members 18 and 19. The ends 12 and 13 of ring 11 have closed loops 14 and 16 that encircle the outer ends of lateral members 18 and 19 to pivotally mount ring 11 on hanger member 17 for movement about a horizontal axis. Lateral members 18 and 19 have inwardly terminated ends that are secured together at 21 with a weld or the like. The inner end of lateral member 19 extends upwardly and is turned downwardly into an inverted C-shaped hook 22. Hook 22 is engageable with any suitable support, such as a pole 27 as seen in FIG. 6, to hang holder 10 thereon. The outer ends of lateral members 18 and 19 have loops 23 and 24 that extend downwardly and terminate in a generally L-shaped member 26. Member 26 has a horizontal U-shaped body 31 and upwardly extended arms 32 and 33 joined to loops 23 and 24. Loops 14 and 16 extend through loops 23 and 24 to locate ends 12 and 13 outwardly of the arms 32 and 33 of member 26. The lower ends of arms 32 and 33 are located slightly below the upper ends of the circular ring 11. Member 26 extends through ring 11 when holder 10 is in the closed position, as shown in FIGS. 2 and 6.

Figure 5:
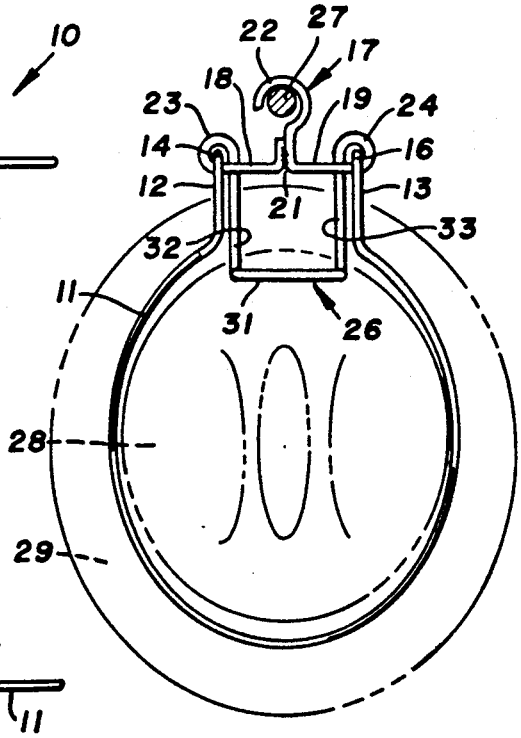
FIG. 5 is a front view of the hat holder of the invention accommodating a hat.

Referring to FIGS. 5 and 6, ring 11 is adapted to fit around side wall adjacent the brim of a hat 28. Horizontal body 31 extends into hat 28 adjacent the top of hat 28 to support the hat and hold the hat inside ring 11. Ends 12 and 13 incline upwardly to hanger member 17 to laterally space ring 11 from hanger member 17. This positions the bill 29 of hat 28 away from hanger member 17 so that bill 29 is not crushed between ring 11 and hanger member 17 thereby preserving the shape of bill 29. Hook 22 is adapted to be placed on a pole 27 or like support to hang hat 28 in a closet or on a rack thereby reducing risk of damage to the hat.

Figure 1:
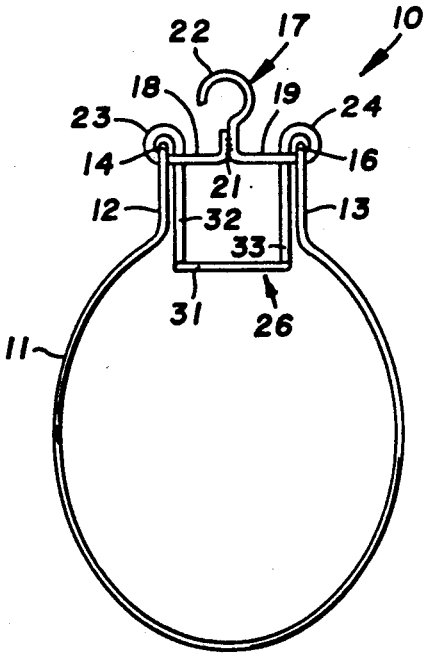
FIG. 1 is a front view of the hat holder of the invention.
Figure 2:
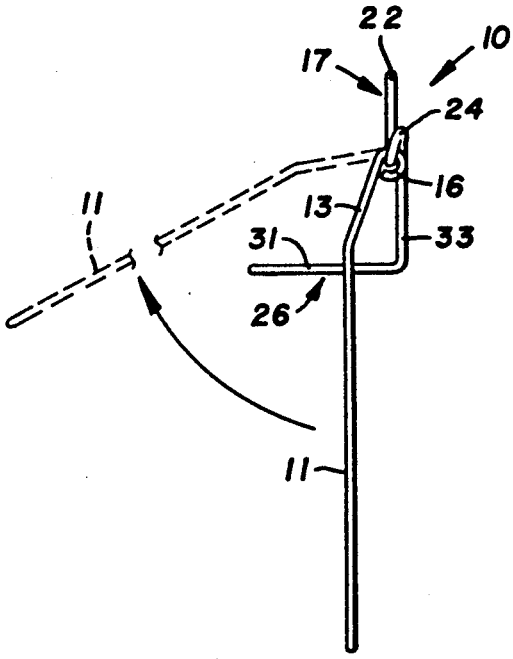
FIG. 2 is a side view of FIG. 1.
Figure 3:
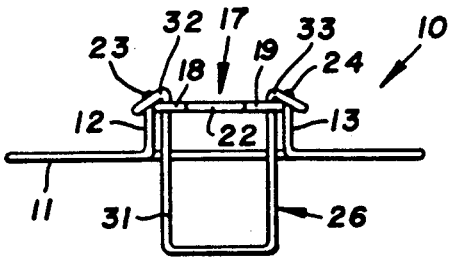
FIG. 3 is a top view of FIG. 1.
Figure 4:
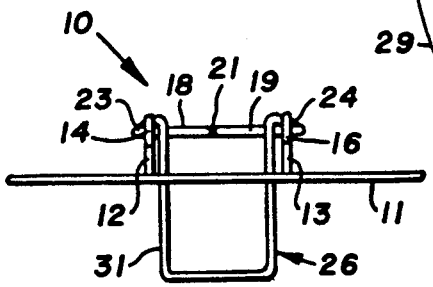
FIG. 4 is a bottom view of FIG. 1.

In use, holder 10 is moved to an open position by pivoting ring 11 relative to hanger member 17 to separate ring 11 from member 26 as shown in broken lines in FIG. 2. Hat 28 is placed on body 31. Ring 11 is then pivoted down over the crown and side wall of hat 28 adjacent bill 29. Ring 11 remains in the closed position due to gravity since the upper end of ring 11 is pivotally connected to hanger member 17. Ring 11, fitted over the crown and side wall of hat 28, maintains the shape of the hat. Horizontal body 31 extends into the interior of hat 28 adjacent the top of the hat to support the hat thereon and hold the hat within ring 11. Inclined ends 12 and 13 of ring 11 prevent bill 29 of hat 28 from being crushed between hanger member 17 and ring 11. Horizontal body 31 prevents the crown of hat 28 from collapsing toward bill 29. Ring 11 and horizontal body 31 cooperate to securely hold hat 28 on holder 10 when the holder is in the closed position as shown in FIG. 6. Hook 22 can then be placed on a support such as pole 27 located within a closet or on a rack to neatly and safely store hat 28. The hat 28 is removed from holder 10 by pivoting ring 11 upwardly away from hanger member 17. Hat 28 is then removed from body 28. When ring 11 is released, gravity will return ring 11 to the closed position, as shown in FIG. 2.

While there has been shown and described a preferred embodiment of the hat holder of the invention, it is understood that changes in materials, structure, and arrangement of structure may be made by those skilled in the art without departing form the invention. The invention is defined in the following claims.

I claim:

1. A holder for accommodating a hat comprising: hanger means mountable on a support, ring means adapted to fit around a hat, means pivotally connecting the ring means on the hanger means, the hanger means including body means having a generally U-shaped member adapted to fit into the interior of the hat to support the hat and hold the hat within the ring means.

2. The holder of claim 1 wherein: the ring means is a generally circular ring having upwardly and inwardly extending ends, the ends being joined to the means pivotally connecting the ring means on the hanger means.

3. The holder of claim 2 wherein: the hanger means has lateral members that accommodate the means pivotally connecting the ring means on the hanger means.

4. The holder of claim 1 wherein: the hanger means includes a downwardly turned hook adapted to be placed on a support.

5. The holder of claim 1 wherein: the hanger means has lateral members having loops and arms extending downwardly to the body means, said ring means having upwardly directed ends, said means pivotally connecting the ring means on the hanger means comprising loops on the ends of the ring means extended through the loops of the hanger means.

6. The holder of claim 1 wherein: the body means extends through the ring means adjacent a top portion of the hat when the holder is in a closed position.

7. A hat holder comprising: hanger means mountable on a support, a generally circular ring adapted to surround a hat, the ring having a pair of upper ends terminating in first loops pivotally supported on the hanger means, the hanger means having a plurality of lateral members, each lateral member having a second loop, arms extended downwardly from the second loops, and horizontal body means including a generally U-shaped member connected to the arms adapted to fit into the interior of the hat thereby supporting the hat and holding the hat within the ring, said first loops extended through the second loops to pivotally mount the ring on the hanger means.

8. The holder of claim 7 wherein: the upper ends of the ring extend upwardly and inwardly to the lateral members.

9. The holder of claim 7 wherein: the hanger means has a downwardly turned hook adapted to be placed on a support.

10. The holder of claim 7 wherein: the U-shaped member extends through the ring adjacent lower ends of the arms into a top portion of the hat when the holder is in a closed position.

11. A holder for accommodating a hat comprising: hanger means mountable on a support, ring means for accommodating a hat pivotally mounted on the hanger means, the hanger means including a generally U-shaped horizontal member adapted to fit into the interior of the hat thereby supporting the hat, the ring means and the horizontal member cooperating to retain the hat on the holder.

12. The holder of claim 11 wherein: the hanger means includes a hook adapted to be placed on a support.

13. The holder of claim 11 wherein: the ring means includes upwardly and inwardly extending ends pivotally mounted on the hanger means, the ends transversely spacing the ring means from the hanger means.

14. The holder of claim 11 wherein: the horizontal member extends through the ring means adjacent a top portion of the hat when the holder is in a closed position.

15. The holder of claim 11 including: loop means on the ring means pivotally connecting the ring means to the hanger means.

16. The holder of claim 15 wherein: the hanger means includes lateral members having second loop means, and said first loop means on the ring means extended through the second loop means to pivotally connect the ring means on the hanger means.

17. The holder of claim 16 wherein: the ring means has upwardly directed ends connected to the second loop means.

18. The holder of claim 17 wherein: the generally U-shaped horizontal member is positioned a short distance generally below lower portions of said ends.

19. A hat holder comprising: hanger means including lateral support means adapted to laterally extend into an inner portion of a hat to support the hat, and ring means mounted on the hanger means and engageable with an outer portion of the hat to retain the hat on the support means.

20. The holder of claim 19 including: means pivotally connecting the ring means to the hanger means whereby the ring means is moveable between an open position and a closed position relative to the support means.

21. The holder of claim 20 wherein: the ring means surrounds an inner end of the support means when the ring means is located in the closed position thereby retaining the hat on the support means.

22. The holder of claim 19 wherein: the ring means comprises a generally circular ring having ends inclining upwardly to the hanger means thereby transversely spacing the ring from the hanger means.

23. The holder of claim 22 wherein: the support means is positioned a short distance generally below lower portions of said ends.

24. The holder of claim 23 wherein: the support means comprises a generally U-shaped member.

* * * * *